US011142377B2

(12) United States Patent
Johnson

(10) Patent No.: US 11,142,377 B2
(45) Date of Patent: Oct. 12, 2021

(54) EASY TO REMOVE CAP DESIGN

(71) Applicant: Liqui-Box Corporation, Richmond, VA (US)

(72) Inventor: James W. Johnson, Delaware, OH (US)

(73) Assignee: LIQUI-BOX CORPORATION, Richmond, VA (US)

( * ) Notice: Subject to any disclaimer, the term of this patent is extended or adjusted under 35 U.S.C. 154(b) by 35 days.

(21) Appl. No.: 16/143,615

(22) Filed: Sep. 27, 2018

(65) Prior Publication Data

US 2019/0092538 A1 Mar. 28, 2019

Related U.S. Application Data

(60) Provisional application No. 62/564,061, filed on Sep. 27, 2017.

(51) Int. Cl.
*B65D 47/08* (2006.01)
*B65D 41/18* (2006.01)
*B65D 47/20* (2006.01)

(52) U.S. Cl.
CPC ..... *B65D 47/0842* (2013.01); *B65D 41/185* (2013.01); *B65D 47/2031* (2013.01); *B65D 2547/066* (2013.01)

(58) Field of Classification Search
CPC ..... B65D 47/0842; B65D 41/185; B65D 47/2031; B65D 2547/066
USPC ..... 220/254.3; 215/235
See application file for complete search history.

(56) References Cited

U.S. PATENT DOCUMENTS 3,604,585 A * 9/1971 Towns ..... B65D 55/02 215/235
5,632,420 A * 5/1997 Lohrman ..... B65D 47/0838 222/212
2001/0052531 A1 12/2001 Randall et al.
2004/0251278 A1* 12/2004 Arai ..... B65D 47/2031 222/212
2009/0084814 A1 4/2009 Wisniewski et al.
2009/0294447 A1 12/2009 Mazurkiewicz et al.
2010/0176152 A1 7/2010 Johnson
2011/0210122 A1* 9/2011 Benoit-Gonin .... B65D 41/3447 220/277

(Continued)

FOREIGN PATENT DOCUMENTS

EP 1441960 B1 3/2011
WO WO 03/031277 A1 4/2003

(Continued)

*Primary Examiner* — J. Gregory Pickett
*Assistant Examiner* — Niki M Eloshway
(74) *Attorney, Agent, or Firm* — McAndrews, Held & Malloy, Ltd.

(57) ABSTRACT

Disclosed herein is a dispensing assembly for dispensing flowable material from a container. The dispensing assembly has a spout that communicates with the flowable material and defines a spout retention element. The assembly further has a cap configured to releasably attach to the spout. The cap has a first collar and a second collar, the first collar defining a cap retention element. The cap retention element is configured to contact the spout retention element such that the cap is affixed to the spout, and the engagement between the cap retention element and the spout retention element is reversible, such that the cap is removed from contacting the spout.

20 Claims, 10 Drawing Sheets

(56) References Cited

U.S. PATENT DOCUMENTS

| | | | | |
|---|---|---|---|---|
| 2014/0263149 | A1* | 9/2014 | Berge | B65D 1/0246 215/44 |
| 2015/0083759 | A1* | 3/2015 | Medeiros | B65D 23/02 222/494 |
| 2015/0320638 | A1* | 11/2015 | Becker | A61J 1/1475 215/306 |
| 2018/0207061 | A1* | 7/2018 | Fox | A61J 1/1406 |
| 2018/0244440 | A1* | 8/2018 | Beilke | B65D 47/0804 |

FOREIGN PATENT DOCUMENTS

| | | | |
|---|---|---|---|
| WO | 2017013081 | A1 | 1/2017 |
| WO | 2017082892 | A1 | 5/2017 |

* cited by examiner

EASY TO REMOVE CAP DESIGN

CROSS REFERENCE TO RELATED APPLICATIONS

This application claims the benefit of U.S. Provisional Application No. 62/564,061, filed Sep. 27, 2017, the entirety of which is incorporated herein for any and all purposes.

TECHNICAL FIELD

This invention relates to a dispensing assembly for use with flexible containers for flowable materials.

BACKGROUND

Flexible polymeric containers are extensively used throughout the food service industry for storing and dispensing soft drink syrups and other such beverages, as well as wine, dairy products, enteral feeding solutions, fruit juices, tea and coffee concentrates, puddings, cheese sauces, and many other flowable materials, including those that must be filled aseptically.

The flexible polymeric containers may have inlets and/or spouts for filling and dispensing the container contents. The containers are also often placed within a corrugated paper box. Such packaging systems are commonly referred to as "bag-in-box" systems wherein the spout extends through an opening in the box to dispense the contents. Bag-in-box packaging systems are often used in restaurants, institutional food service centers, and convenience stores to facilitate service of liquid food products such as syrups, toppings, condiments, beverages and dairy products. These containers typically have a capacity of 1 to 6 gallons.

Fluid transfer assemblies are used to move fluid into the containers. The fluid transfer assemblies are also used to dispense the fluid from the containers. Existing fluid transfer assemblies lack suitable methods of creating and maintaining reusable aseptic seals. Additionally, existing cap designs are difficult to use when they need to be connected to a spout or disconnected from the spout.

SUMMARY

According to an embodiment of the present disclosure, a dispensing assembly for dispensing flowable material from a container includes a spout having an interior surface configured to communicate with the flowable material and an exterior surface defining a spout retention element. The dispensing assembly further includes a cap a cap configured to releasably attach to the spout. The cap has a first collar and a second collar, and the first collar defines a cap retention element. The cap retention element is configured to contact the spout retention element such that the cap is affixed to the spout, and the engagement between the cap retention element and the spout retention element is reversible, such that the cap is removed from contacting the spout.

According to another embodiment, a method of introducing fluid into a container through a dispensing assembly includes the steps of moving fluid into the container through a spout fixedly attached to the container and affixing a cap to the spout by contacting a cap retention element disposed on the cap with a spout retention element disposed on the spout.

According to yet another embodiment, a method of dispensing fluid from a collapsible bag uses a dispensing assembly that has a spout fixedly attached to the collapsible bag and a cap attached to the spout. The method includes the steps of opening the dispensing assembly such that the fluid is permitted to move from the collapsible bag through the spout and out of the dispensing assembly and actuating movement of the fluid from the collapsible bag through and out of the dispensing assembly.

According to yet another embodiment, a fitment for use on a collapsible bag for dispensing of fluids from the collapsible bag includes a spout having an exterior surface defining a spout retention element and a cap having a first collar and a second collar. The spout has having a flange configured to engage with the collapsible bag. The cap defines a gap between the first collar and the second collar. The cap further has a cap retention element disposed on the first collar, and the cap retention element is configured to releasably engage with the spout retention element. The cap is configured to receive the spout in the gap defined between the first collar and the second collar, and the cap retention element is configured to contact the spout retention element such that the cap is affixed to the spout.

BRIEF DESCRIPTION OF THE DRAWINGS

The present application is further understood when read in conjunction with the appended drawings. For the purpose of illustrating the subject matter, there are shown in the drawings exemplary embodiments of the subject matter; however, the presently disclosed subject matter is not limited to the specific methods, devices, and systems disclosed. Furthermore, the drawings are not necessarily drawn to scale. In the drawings.

DETAILED DESCRIPTION OF ILLUSTRATIVE EMBODIMENTS

Figure 1:
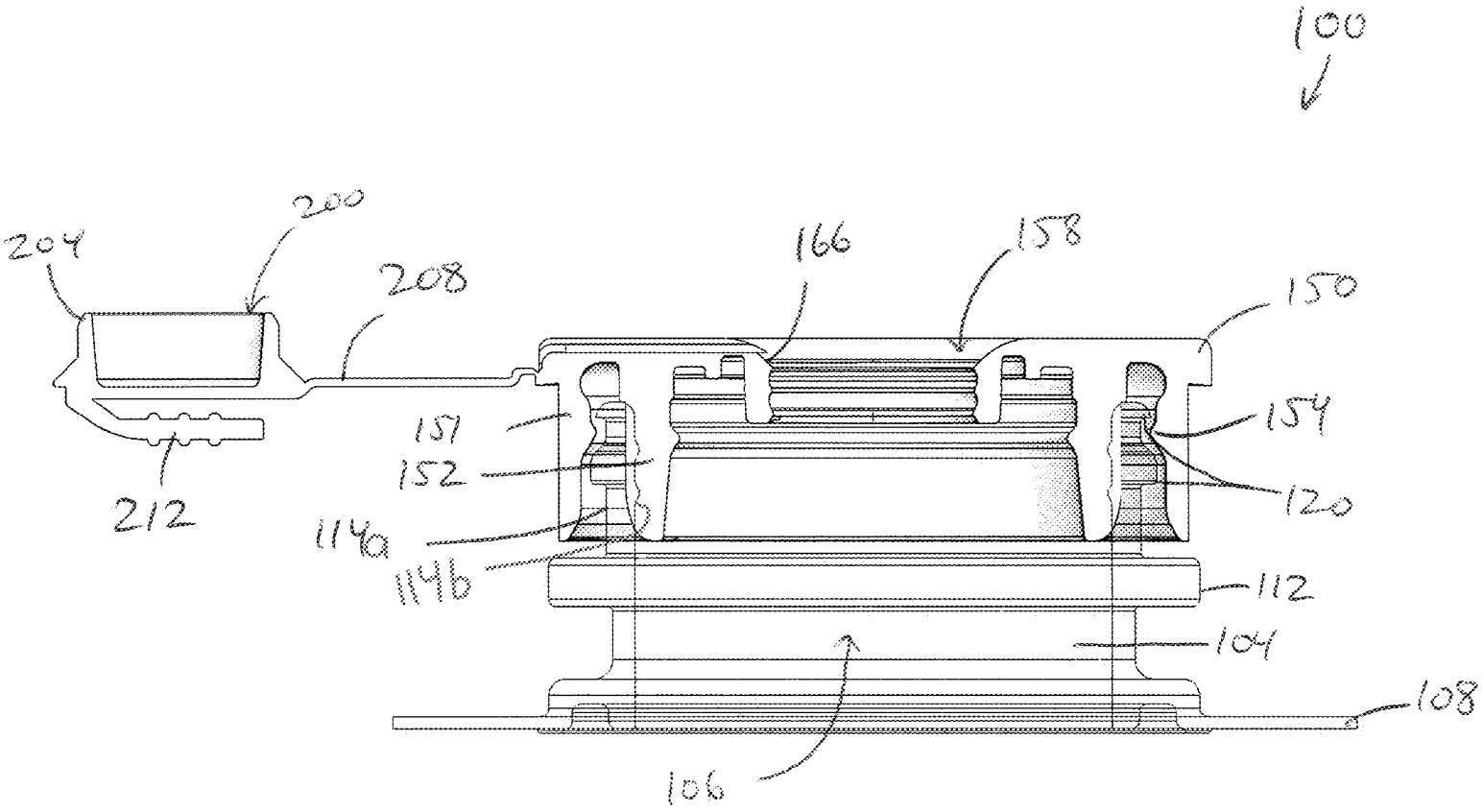
FIG. 1 illustrates a cross-sectional view of a dispensing assembly according to an embodiment of the present disclosure.
Figure 2:
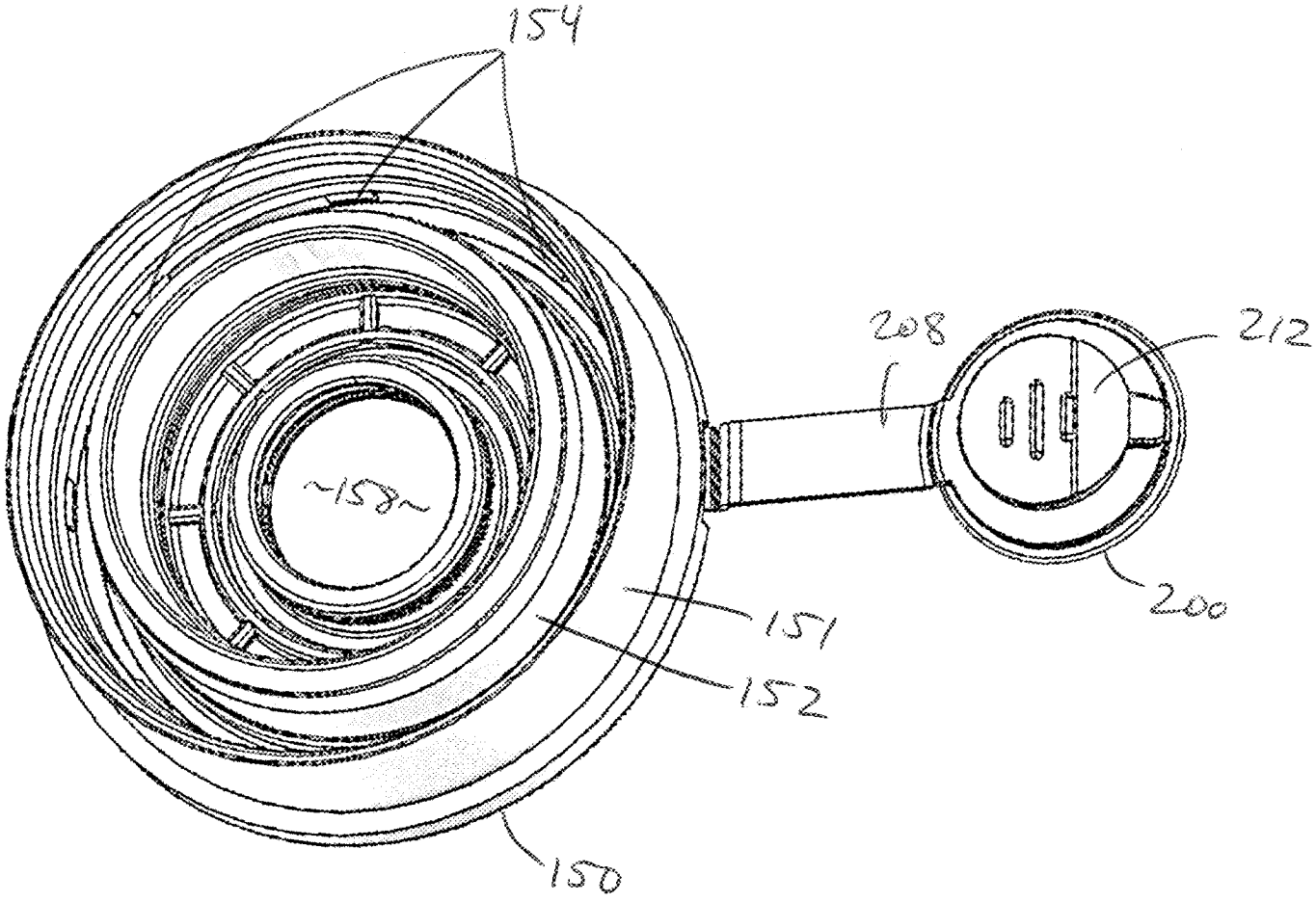
FIG. 2 illustrates an isometric view of a cap according to an embodiment.
Figure 3:
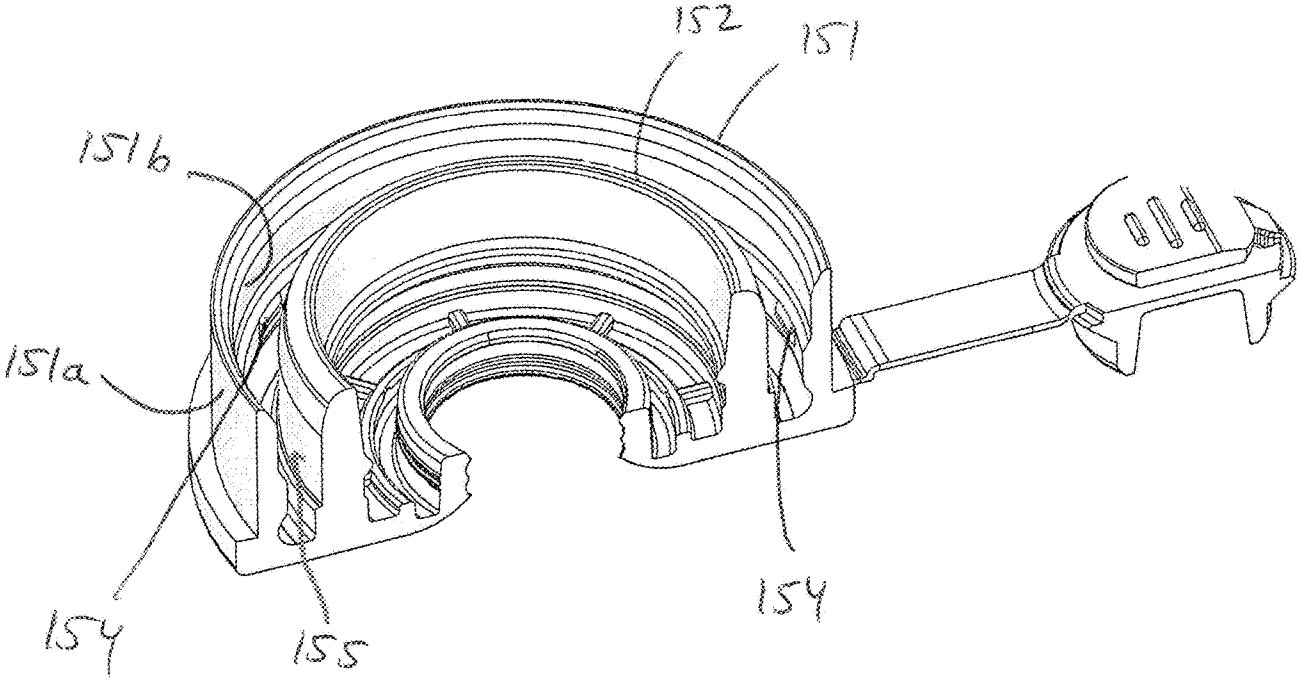
FIG. 3 illustrates a cross-sectional view of the cap shown in FIG. 2.
Figure 4:
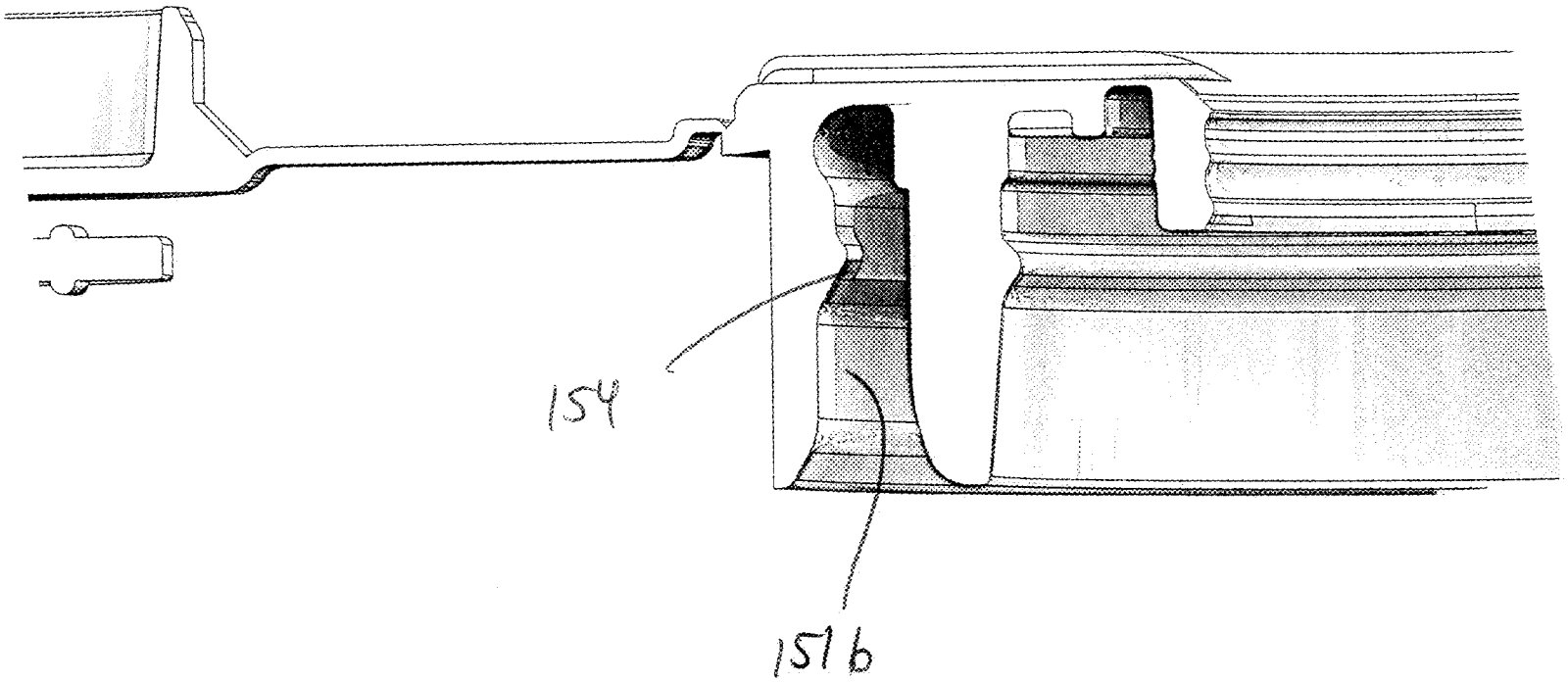
FIG. 4 illustrates a cross-sectional view of the cap shown in FIGS. 2 and 3.
Figure 5:
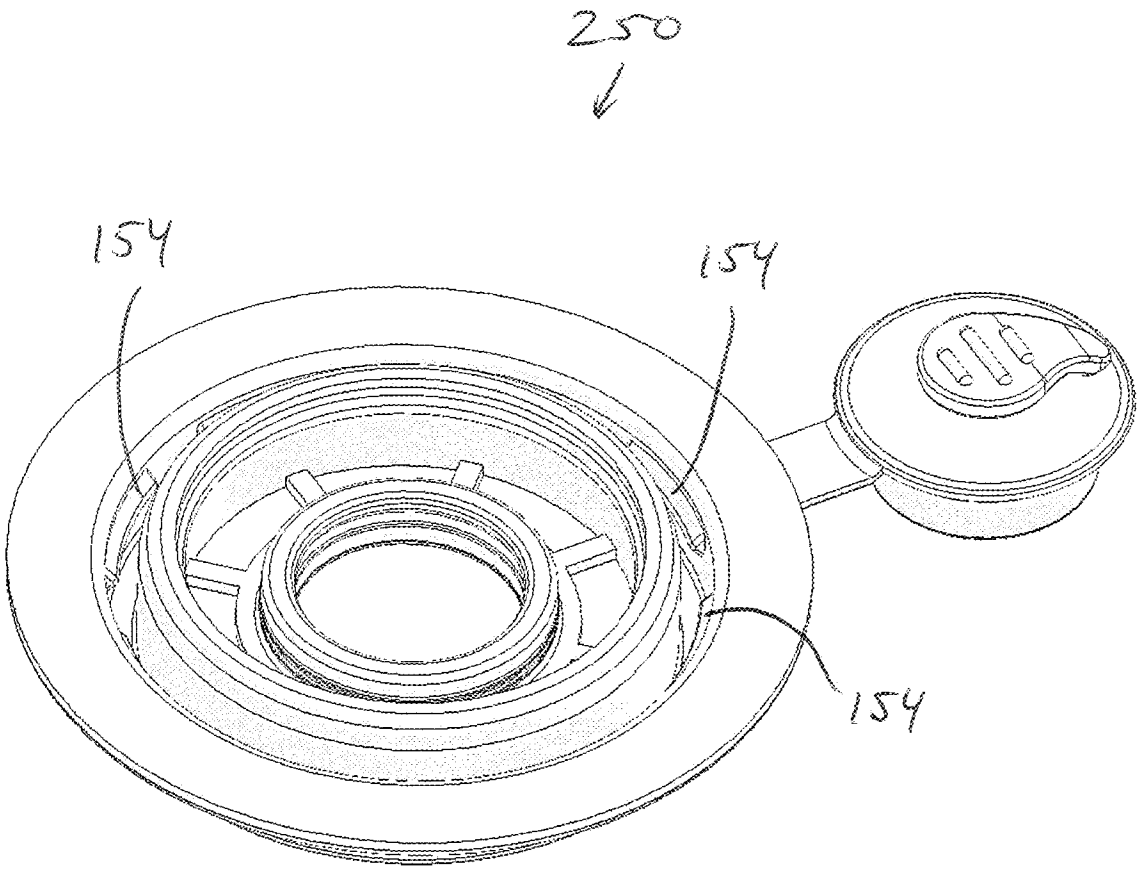
FIG. 5 illustrates an isometric view of a cap according to another embodiment.
Figure 6:
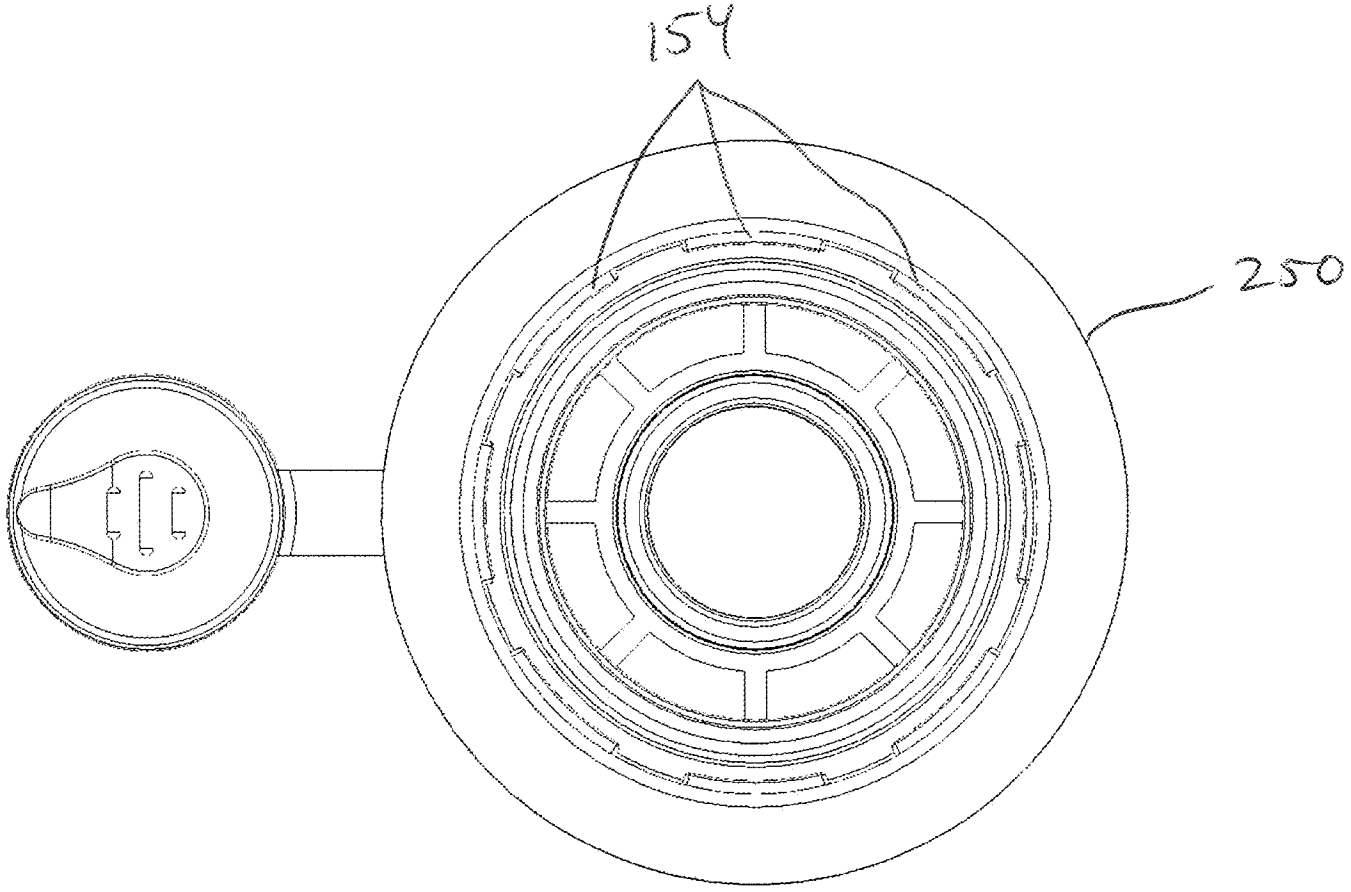
FIG. 6 illustrates a bottom perspective view of the cap shown in FIG. 5.
Figure 7:
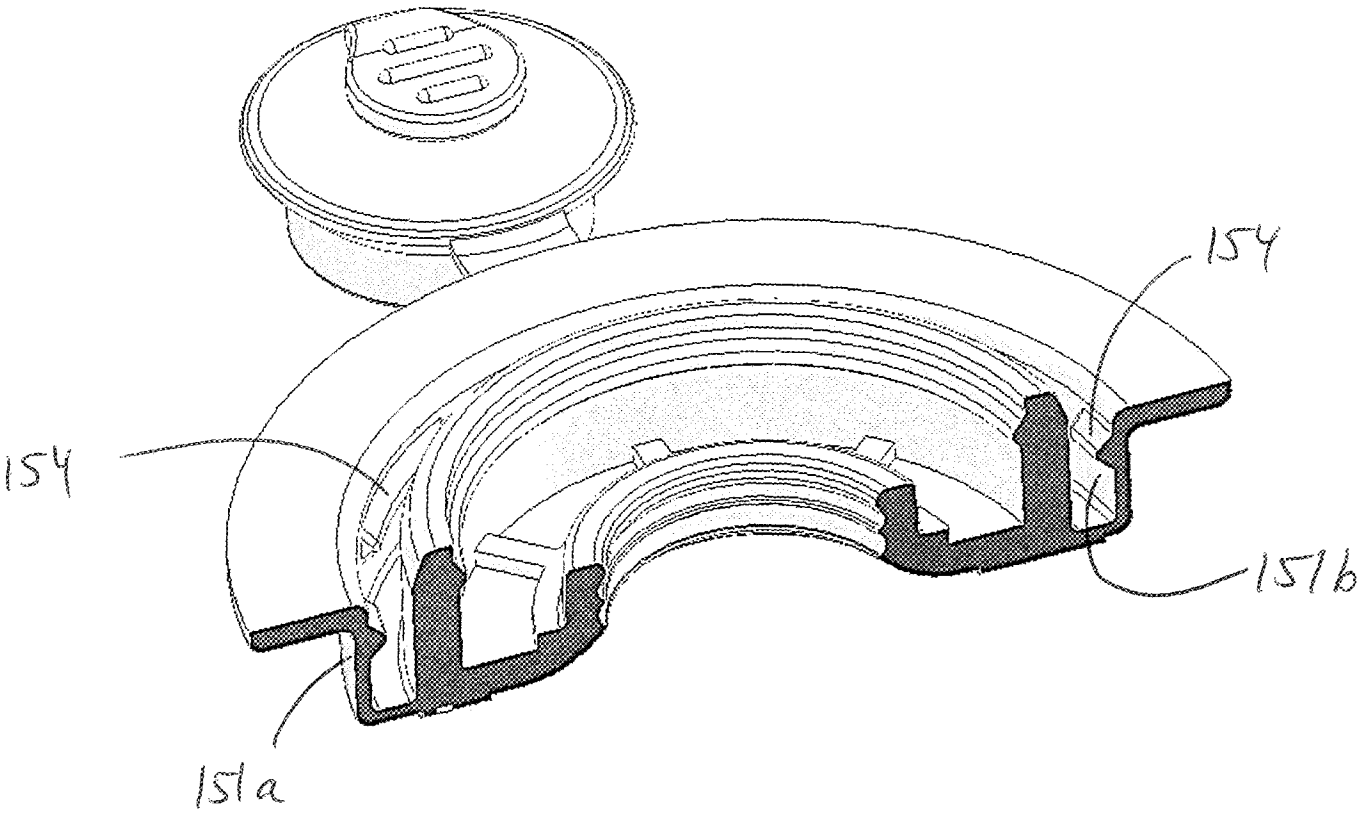
FIG. 7 illustrates a cross-sectional view of the cap shown in FIGS. 5 and 6.
Figure 8:
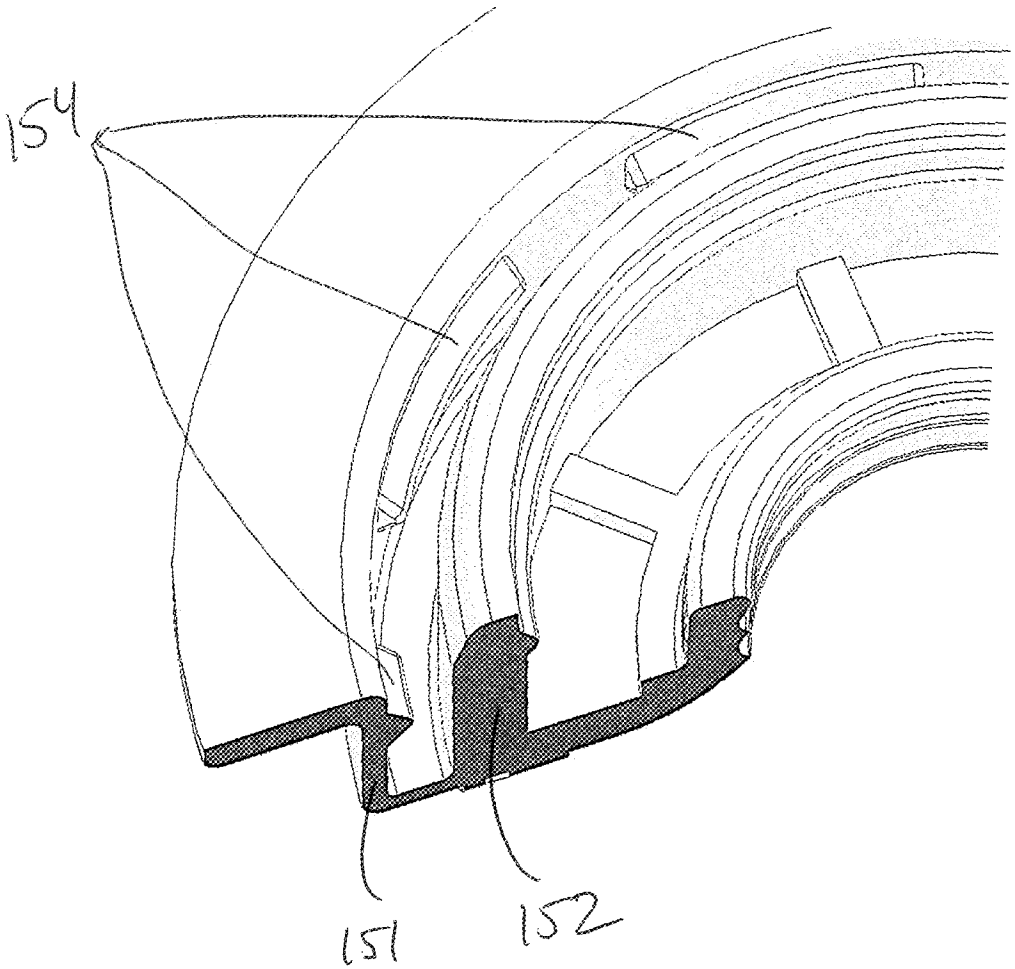
FIG. 8 illustrates a close-up cross-sectional view of the cap of FIGS. 5-7.
Figure 9:
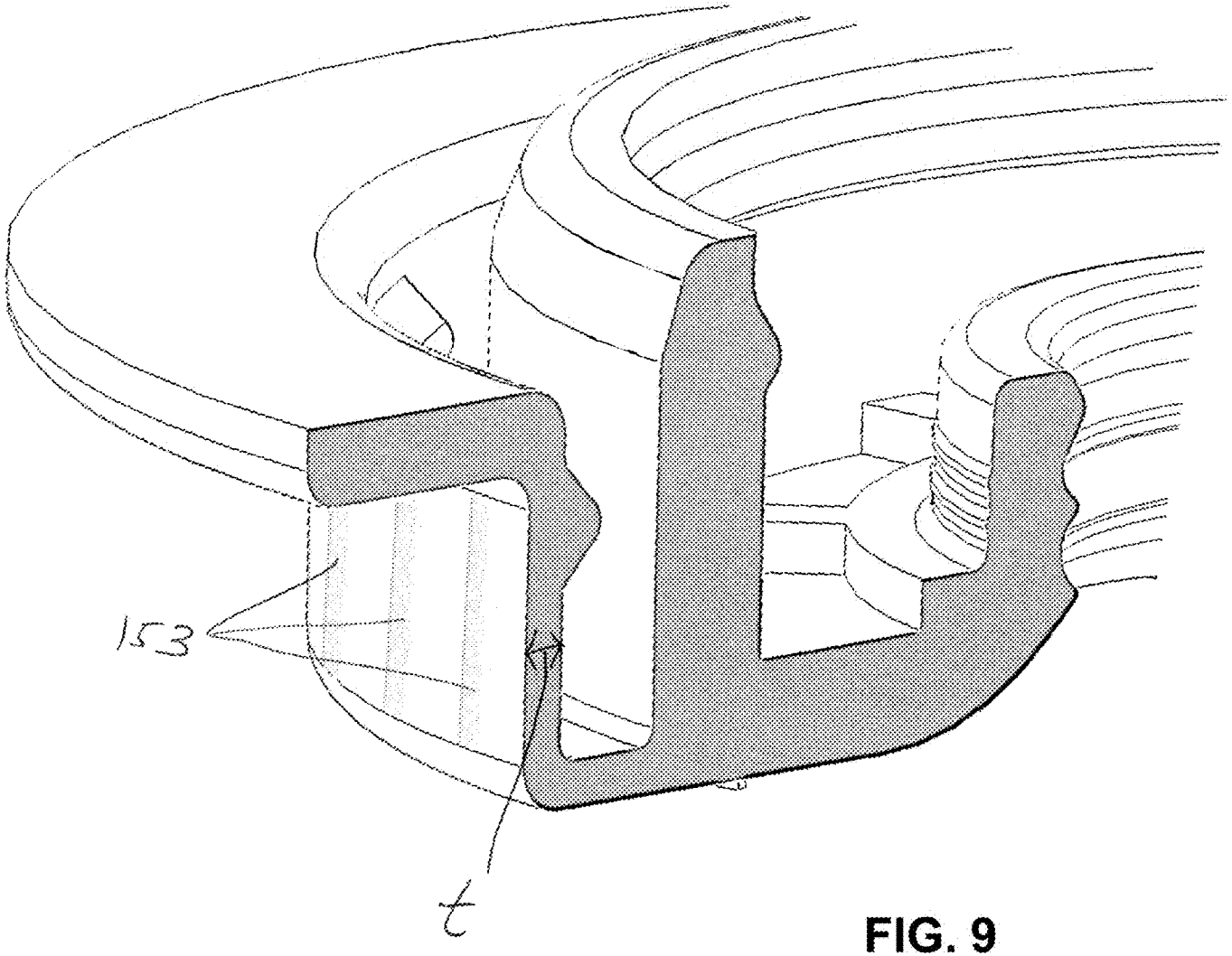
FIG. 9 illustrates another close-up cross-sectional view of the cap of FIGS. 5-8.

Aspects of the disclosure will now be described in detail with reference to the drawings, wherein like reference numbers refer to like elements throughout, unless specified otherwise. Certain terminology is used in the following description for convenience only and is not limiting.

The term "plurality," as used herein, means more than one. The singular forms "a," "an," and "the" include the plural reference, and reference to a particular numerical value includes at least that particular value, unless the context clearly indicates otherwise. Thus, for example, a reference to "a material" is a reference to at least one of such materials and equivalents thereof known to those skilled in the art, and so forth.

The transitional terms "comprising," "consisting essentially of," and "consisting" are intended to connote their generally in accepted meanings in the patent vernacular; that is, (i) "comprising," which is synonymous with "including," "containing," or "characterized by," is inclusive or open-ended and does not exclude additional, unrecited elements or method steps; (ii) "consisting of" excludes any element, step, or ingredient not specified in the claim; and (iii) "consisting essentially of" limits the scope of a claim to the specified materials or steps "and those that do not materially affect the basic and novel characteristic(s" of the claimed invention. Embodiments described in terms of the phrase "comprising" (or its equivalents), also provide, as embodiments, those that are independently described in terms of "consisting of" and "consisting essentially of."

When values are expressed as approximations by use of the antecedent "about," it will be understood that the particular value forms another embodiment. In general, use of the term "about" indicates approximations that can vary depending on the desired properties sought to be obtained by the disclosed subject matter and is to be interpreted in the specific context in which it is used, based on its function, and the person skilled in the art will be able to interpret it as such. In some cases, the number of significant figures used for a particular value may be one non-limiting method of determining the extent of the word "about." In other cases, the gradations used in a series of values may be used to determine the intended range available to the term "about" for each value. Where present, all ranges are inclusive and combinable. That is, reference to values stated in ranges includes each and every value within that range.

When a list is presented, unless stated otherwise, it is to be understood that each individual element of that list, and every combination of that list, is a separate embodiment. For example, a list of embodiments presented as "A, B, or C" is to be interpreted as including the embodiments, "A," "B," "C," "A or B," "A or C," "B or C," or "A, B, or C."

Throughout this specification, words are to be afforded their normal meaning as would be understood by those skilled in the relevant art. However, so as to avoid misunderstanding, the meanings of certain terms will be specifically defined or clarified.

A dispensing assembly 100 may include a spout 104 coupled with a cap 150. The spout may be attached to a source of dispensing fluid, for example a container or flexible bag. The cap may be attached to the spout prior to the spout being connected to the source or after. It will be appreciated that the cap can be an aseptic cap used in an aseptic environment, or a standard cap used in a non-aseptic environment.

Referring to FIG. 1, a spout 104 may include a flange 108 located at the base of the spout. The flange 108 attaches to the dispensing source (not shown) such that the spout is fixedly connected to the source. The spout 104 includes a passage 106 extending therethrough. When the spout 104 is connected to the source, the passage 106 is in fluid communication with the source such that dispensing fluid can flow from the source into the spout 104 through the passage 106.

The spout 104 may include various structural features configured to facilitate connections to other components. As shown in FIG. 1, the spout 104 may include an intermediary flange 112 extending circumferentially around the spout 104. In some embodiments, the spout 104 may include one or more locking flanges. In some embodiments, the spout 104 may include multiple sidewalls disposed radially around the passage 106. Referring still to FIG. 1, the spout 104 may include a sidewall 114. The sidewall 114 may extend around the circumference of the spout 104 and may have a substantially circular cross-section with a first diameter.

Figure 10:
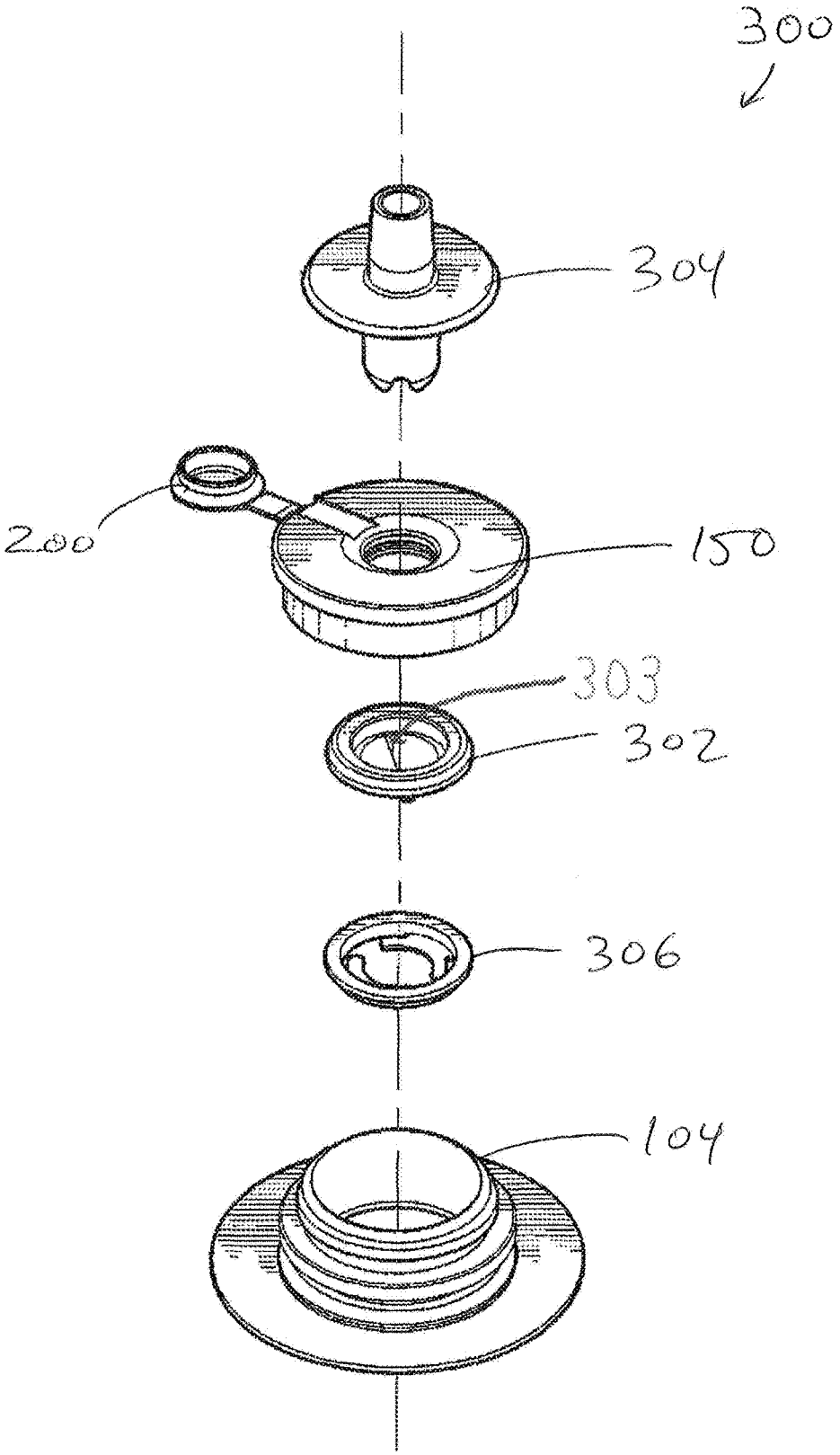
FIG. 10 illustrates a dispensing assembly according to another embodiment.

Referring to FIGS. 1-4, a cap 150 removably attaches to the spout 104. The cap may have a first collar 151 and a second collar 152. The first collar 151 may extend circumferentially around the cap 150 and may have a substantially circular cross-section with a second diameter. The second collar 152 of the cap may extend circumferentially around the cap 150 and may have a substantially circular cross-section with a third diameter that is smaller than the second diameter. The first and second collars 151, 152 may be configured to engage with the sidewall 114 of the spout 104. The sidewall 114 may be disposed in a gap 155 defined between the first and second collars 151, 152. In some embodiments, the second diameter is greater than the first diameter such that the cap's first collar 151 surrounds the spout's sidewall 114 on an exterior surface 114*a* of the sidewall 114. The third diameter may be smaller than the first diameter such that the cap's second collar 152 surrounds the spout's sidewall 114 on an interior side 114*b* of the sidewall 114. In some embodiments, the cap's second collar 152 may be configured to engage with a separate component of the assembly 100, for example, a valve, such as a duckbill valve (see. FIG. 10).

The cap 150 may be configured to securely attach to the spout 104. The attachment may be intended to be easily reversed to remove the cap 150, or, alternatively, the cap 150 may be configured to be fixedly attached to the spout 104 such that it cannot be easily removed without excessive force or damaging the spout, the cap, or both. The cap 150 may attach to the spout 104 via a friction fit between the sidewall 114 and the first collar 151, the sidewall 114 and the second collar 152, or the sidewall 114 and both, the first and second collars 151, 152.

The spout 104 and the cap 150 may be used in either aseptic or non-aseptic environments. In some aspects, it may be advantageous to secure the cap 150 to the spout 104 after the fluid has been introduced into the container, such that the cap 150 cannot be easily removed from the spout 104 by a user. In an aseptic environment, this prevents accidental removal of the cap 150 from the spout 104.

In some embodiments, the dispensing assembly 100 may have one or more spout retention elements 120 configured to facilitate fixing of the cap 150 on the spout 104. Referring still to FIGS. 1-4, the spout retention element 120 may be disposed on the sidewall 114 of the spout 104. In some embodiments, corresponding retention elements may be disposed on the collars of the cap 150. As shown in the illustrative embodiment in the figures, a cap retention element 154 may be disposed on the first collar 151 of the cap 150. Additionally, or alternatively, one or more cap retention elements 154 may be disposed on the second collar 152 of the cap 150. It will be understood that the spout retention elements 120 and the cap retention elements 154 may be the same type of retention element, or they may include various types of retention elements. Retention elements may include, but are not limited to, protrusions, sealing beads, stop ridges, gaskets, or other suitable structures configured facilitate connection between two or more adjacent components.

FIGS. 6-9 depict an alternative embodiment showing a cap 250. With respect to the cap 250, like reference numbers refer to like elements as described throughout this application unless noted otherwise.

In some embodiments, the spout retention elements 120 and the cap retention elements 154 are continuous ribs that extend radially along the circumference of the spout and cap, respectively. When the cap 150 is positioned on the spout 104 such that the retention elements overlap, the spout retention elements 120 engage with the cap retention elements 154 to create a fixed attachment of the cap 150 with the spout 104. In embodiments with numerous and/or continuous retention elements, the force required to separate the cap 150 from the spout 104 may be sufficiently high that the cap 150 cannot be easily removed from the spout 104 without excessive force. This may decrease instances of accidental uncoupling of the cap 150 from the spout 104.

It will be understood that to make the engagement between the cap 150 and the spout 104 stronger (i.e. requiring more force to de-couple the cap 150 from the spout 104), different types or arrangements of the cap retention elements 154 may be present. The cap 150 may include 1, 2, 3, . . . , 20, or another suitable number of cap retention elements 154. All of the cap retention elements 154 may be the same, or at least some of the cap retention elements 154 may vary in size or shape.

In some embodiments, it may be desirable to have an attachment that can be reversed with less force. Specifically, it may be advantageous for the user to be able to easily remove the cap 150 from the spout 104 in order to attach a dispensing connector (not shown) or another dispensing component. In such embodiments, the plug 200 can remain within the opening 158, and the entire cap 150 can be removed from the spout 104. Furthermore, in such embodiments, the cap 150 may be devoid of an opening 158 and a corresponding plug 200. Some or all of the retention elements 120, 154 may be discontinuous around the circumference of the spout 104 and cap 150, respectively. In some embodiments, the retention elements 120, 154 may be smaller and may be configured to flex when sufficient force is applied. In some embodiments, the spout 104 and cap 150 may have a plurality of retention elements 120, 154.

The cap retention elements 154 may be disposed circumferentially along an external surface 151*a* of the first collar 151, such that the cap retention elements 154 can engage the corresponding spout retention elements 120 disposed on the exterior surface 114*a* of the spout 104. The dispensing assembly 100 can be manufactured with cap retention elements 154 that correspond to the desired amount of force that needs to be applied to the cap 150 to de-couple the cap 150 from the spout 104. The less force for de-coupling is desirable, the fewer cap retention elements 154 may be present on the cap 150, and/or the smaller each cap retention element 154 may be. The less force that is required, the easier it is for a user to remove the cap 150 from the spout 104. Conversely, the more force that is desired, the more cap retention elements 154 may be present, and/or the larger (i.e. one or more of the three-dimensional measurements of length, width, and thickness) the cap retention elements 154 may be. The more force that is required, the harder it is for the user to remove the cap 150 from the spout 104. Furthermore, the cap retention elements 154 and/or the spout retention elements 120 may be manufactured such that they are less rigid than other portions of the cap or spout, respectively, such that they can be deformed with a lower de-coupling force, as desired.

In some embodiments, the required de-coupling force can be controlled by the flexibility of the first collar 151, either in addition to or instead of the cap retention elements 154 described above. Specifically, the thickness t of the first collar 151, measured orthogonally from the external surface 151*a* to an internal surface 151*b*, can be increased to increase rigidity of the cap 150, and thus to increase the de-coupling force. Conversely, reducing the thickness t of the first collar 151 will decrease rigidity of the cap 150 and decrease the de-coupling force relative to the increased thickness t. In some embodiments, a plurality of ribs 153 may be disposed on the external surface 151*a*, the internal surface 151*b*, or both surfaces to maintain the structural integrity of the first collar 151. It will be appreciated that the ribs 153 will allow for a relatively thinner thickness t of the first collar 151 located between adjacent ribs 153.

The cap 150 can include an opening 158 extending through the cap 150. The opening 158 is defined by a cap wall 166. When the cap 150 is connected to the spout 104, the opening 158 fluidly communicates with the passage 106 extending through the spout 104. The opening 158 may receive a dispensing tool or may be configured to connect to another dispensing component, for example, a valve, a pump, a hose, or another component used in dispensing flowable material.

In some embodiments, the opening 158 may be configured to be releasably sealed with a plug 200. The plug 200 has a body 204 that is configured to fit into or onto the opening 158 of the cap 150. In some embodiments, the body 204 is slightly smaller than the opening 158 such that the plug 200 can be inserted into the opening 158 and held via friction fit interaction between the body 204 and the cap wall 166. The plug 200 creates a fluid-tight aseptic seal within the opening 158 such that liquid cannot move from the spout 104 through the opening 158 and out of the dispensing assembly 100. In an aseptic environment, this structure allows the user to access the fluid within the container by removing the plug 200 from the cap 150, rather than by removing the cap 150 from the spout 104. An aseptic probe (see. FIG. 10) or a similar dispensing component can be inserted into the opening 158, and fluid can be dispensed from within the container without de-coupling the cap 150 from the spout 104.

In some embodiments, the plug 200 may include a handle 212 attached thereto. A user may push on the handle 212 toward the cap 150 to move the plug 200 into the opening 158 to create the fluid-tight seal. To remove the plug 200, the user may pull the handle 212 away from the cap 150. In some embodiments, the plug 200 may be attached to the cap 150 via a connector 208. This allows decreases the likelihood of misplacing or losing the plug 200 when it is removed from the cap 150. Additionally, by allowing the plug 200 to remain connected and in close proximity to the cap 150, the plug 200 does not need to be placed anywhere while the dispensing assembly 100 is being used. This decreases the likelihood of the plug 200 getting dirty or damaged, and it lowers the risk of the user forgetting to re-attach the plug 200 after concluding usage of the dispensing assembly 100.

The dispensing assembly 100 as described herein can be used to introduce a flowable medium into a fluid source for future dispensing (e.g., a flexible bag containing liquid). The method may include moving fluid into the container through the spout 104 fixedly attached to the container and sealing the dispensing assembly 100. In some embodiments, the cap 150 may be attached to the spout 104 after fluid is introduced into the container. In some aspects, it may be easier to move fluid through the spout 104 without the cap 150 because the passage 106 is in some embodiments larger than the opening 158 of the cap. When the cap 150 is attached to the spout 104, the plug 200 may be contacted with the cap 150 as well, either being inserted into the opening 158 or being disposed to cover the opening 158. When the plug 200 is on or within the cap 150, a fluid-tight aseptic seal is formed.

FIG. 10 depicts a dispensing assembly 300, in which like reference numbers refer to like elements as described throughout this application unless noted otherwise. The cap 150 is configured to receive a valve 302. The valve 302 may releasably contact the second collar 152 of the cap 150 and may be held in place via friction fit between the valve 302 and the second collar 152 or by another suitable retention mechanism, for example, threading or adhesive. The assembly 300 may receive a probe 304 that is configured to be removably inserted into the opening 158 of the cap 150 when the plug 200 is not disposed in the opening 158.

A valve lock ring 306 may be positioned between the valve 302 and the spout 104. Upon engagement of the valve 302 with the valve lock ring 306 and the spout 104, the valve lock ring 306 locks into the cap 150 and holds an opening 303 in the valve 302 closed. This prevents seepage or leakage of fluid that is to be dispensed from the bag or container (not shown) to which the spout 104 is attached. Extended periods of holding the liquid container at cold temperatures can cause distortion of the valve 302, thereby allowing liquid to seep through the valve opening 303. The use of the valve lock ring 306 decreases such seepage.

The probe 304, through which the fluid from the bag or container is dispensed, can be molded thermoplastic material and may include a polyolefin, such as polyethylene, copolymers and terpolymers of polyethylene, polypropylene, copolymers and terpolymers of polypropylene, polybutylene and copolymers and terpolymers thereof, fluorocarbon polymers and copolymers thereof, polyvinyl chloride and copolymers thereof, polyvinylidene chloride and fluorocarbon polymers and copolymers thereof. Thermosetting polymers such as epoxy resins, phenolic resins, melamine resins can also be used for dispersing some substances. In some embodiments, polyethylene, polypropylene and copolymers and terpolymers thereof are used.

The dispensing assembly can be utilized to move fluid from the source (e.g., the flexible bag) to a desired location. A user may opening the dispensing assembly 100 such that fluid can move from a container through and out of the fluid transfer assembly and dispense the fluid. To open the dispensing assembly 100, the plug 200 may be moved from the cap 150 such that it no longer contacts the cap 150 and creates a fluid-tight seal. In some embodiments, an additional dispensing component (e.g., a hose or a spout) may be connected to the dispensing assembly 100, for example to the cap 150. When dispensing is complete, the additional dispensing components may be removed, and the plug 200 may be re-introduced to the cap 150 such that a fluid-tight seal is formed again. In some embodiments, the cap 150 may be removed from the spout 104 to open the dispensing assembly 100 and allow the flowable material to move from the container out of the spout 104.

While the disclosure has been described in connection with the various embodiments of the various figures, it will be appreciated by those skilled in the art that changes could be made to the embodiments described above without departing from the broad inventive concept thereof. It is understood, therefore, that this disclosure is not limited to the particular embodiments disclosed, and it is intended to cover modifications within the spirit and scope of the present disclosure as defined by the claims.

Features of the disclosure that are described above in the context of separate embodiments may be provided in combination in a single embodiment. Conversely, various features of the disclosure that are described in the context of a single embodiment may also be provided separately or in any sub-combination. Finally, while an embodiment may be described as part of a series of steps or part of a more general structure, each said step may also be considered an independent embodiment in itself, combinable with other.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed:

1. A dispensing assembly for dispensing flowable material from a container, the dispensing assembly comprising:

a spout having an interior surface configured to communicate with the flowable material and an exterior surface defining a spout retention element; and a cap configured to releasably attach to the spout, the cap having:

a first collar defining a cap retention element;

a second collar spaced radially apart from the first collar;

an end wall extending radially and connecting the first collar and the second collar, wherein the first collar and second collar extend approximately the same distance from the end wall;

a gap defined radially between the first collar and the second collar; and a cap wall spaced radially away from the first collar and the second collar and located entirely on the side of the end wall from which the first collar and second collar extend, wherein the first collar, second collar, and cap wall are all perpendicular to the end wall, the cap wall defining an opening extending through the cap; and wherein the cap retention element is configured to contact the spout retention element such that the cap is affixed to the spout, wherein the cap is configured to receive the spout within the gap defined between the first collar and the second collar and to contact the spout with the first collar and with the second collar when the spout is within the gap;

wherein the engagement between the cap retention element and the spout retention element occurs entirely within the gap, wherein the opening defined by the cap wall is in fluid communication with the interior surface of the spout, wherein the engagement between the cap retention element and the spout retention element is reversible, such that the cap is removed from contacting the spout.

2. The dispensing assembly of claim 1, wherein the first collar defines a plurality of cap retention elements, each of the plurality of retention elements being spaced apart from one another.

3. The dispensing assembly of claim 1, wherein the cap wall opening is configured to removably receive a plug therein, the plug being configured to form an aseptic seal with the cap between the plug and the cap wall.

4. The dispensing assembly of claim 3, wherein the plug includes a handle that extends above a body of the plug such that there is a gap between the handle and body of the plug, wherein the handle is configured to receive a force in a first direction and a second direction opposite the first direction, wherein when force is applied in the first direction the plug is removed from the cap, and when force is applied in the second direction, the plug is attached to the cap.

5. The dispensing assembly of claim 3, wherein the plug is connected to the dispensing assembly by a connector, and the end wall includes a groove configured to receive the connector.

6. The dispensing assembly of claim 1, further including a valve configured to contact the second collar of the cap and configured to receive the flowable material therethrough.

7. The dispensing assembly of claim 1, further comprising a plurality of ribs disposed on the first collar.

8. A method of introducing fluid into a container through a dispensing assembly, the method comprising the steps of:

moving fluid into the container through a spout fixedly attached to the container; and affixing a cap to the spout, the cap having a first collar defining a cap retention element, a second collar spaced radially apart from the first collar, an end wall extending radially connecting the first collar and the second collar, wherein the first collar and second collar extend approximately the same distance from the end wall, and a gap defined radially between the first collar and the second collar, and a cap wall spaced radially away from the first collar and the second collar and located entirely on the side of the end wall from which the first collar and second collar extend, wherein the first collar, second collar, and cap wall are all perpendicular to the end wall, the step of affixing the cap to the spout including receiving the spout within the gap defined between the first collar and the second collar, contacting the spout with the first collar and the second collar, and contacting the cap retention element with a spout retention element disposed on the spout.

9. The method of claim 8, further comprising inserting a plug into an opening defined by the cap wall such that a fluid-tight seal is formed between the plug and the cap wall, wherein the plug includes a cylindrical wall that is received in the opening of the cap wall.

10. A method of dispensing fluid from a collapsible bag using a dispensing assembly, the dispensing assembly having a spout fixedly attached to the collapsible bag and a cap attached to the spout, the cap having a first collar defining a cap retention element, a second collar spaced radially apart from the first collar, an end wall extending radially and connecting the first collar and the second collar, wherein the first collar and second collar extend approximately the same distance from the end wall, and a gap defined radially between the first collar and the second collar, and a cap wall spaced radially away from the first collar and the second collar and located entirely on the side of the end wall from which the first collar and second collar extend, wherein the first collar, second collar, and cap wall are all perpendicular to the end wall, the spout being disposed within the gap between the first collar and the second collar and being in contact with the first collar and the second collar, the spout having a retention element, wherein the engagement between the cap retention element and the spout retention element occurs entirely within the gap, the method comprising:

opening the dispensing assembly such that the fluid is permitted to move from the collapsible bag through the spout and out of the dispensing assembly; and actuating movement of the fluid from the collapsible bag through and out of the dispensing assembly.

11. The method of claim 10, wherein the step of opening the dispensing assembly includes removing a plug from an opening defined in the cap wall such that a fluid-tight seal between the plug and the cap does not exist, the method further comprising the step of inserting a dispensing component into the opening.

12. The method of claim 10, wherein the step of opening the dispensing assembly includes applying a de-coupling force to the cap such that the cap is separated from the spout, the method further comprising the step of affixing a dispensing component to the spout.

13. A fitment for use on a collapsible bag for dispensing of fluids from the collapsible bag, the fitment comprising:

a spout having an exterior surface defining a spout retention element, the spout further having a flange configured to engage with the collapsible bag; and a cap having:

a first collar having a cap retention element thereon;

a second collar;

an end wall extending radially and connecting the first collar and the second collar, wherein the first collar and second collar extend approximately the same distance from the end wall; and a cap wall radially disposed on the cap and located entirely on the side of the end wall from which the first collar and second collar extend, wherein the first collar, second collar and cap wall are all perpendicular to the end wall, the cap wall defining an opening extending through the cap, and wherein the cap defines a gap radially between the first collar and the second collar; and wherein the cap retention element is configured to releasably engage with the spout retention element, wherein the cap is configured to receive the spout in the gap defined between the first collar and the second collar and to contact the spout with the first collar and with the second collar when the spout is within the gap, wherein the engagement between the cap retention element and the spout retention element occurs entirely within the gap, and wherein the cap retention element is configured to contact the spout retention element such that the cap is affixed to the spout.

14. The fitment of claim 13, wherein the cap is configured to be removed from the spout upon application of a predetermined de-coupling force.

15. The fitment of claim 13, wherein the cap includes a plurality of cap retention elements.

16. The fitment of claim 13, wherein the fitment further includes a plug configured to be removably inserted into the opening, such that when the plug is in the opening, a fluid-tight seal is formed between the plug and the cap, wherein the plug includes a cylindrical wall that is received in the opening of the cap wall.

17. The fitment of claim 13, further including a valve configured to contact the second collar of the cap and configured to receive the fluid therethrough.

18. The fitment of claim 17, further comprising a valve lock ring configured to be disposed between the valve and the spout.

19. The fitment of claim 18, wherein the valve lock ring is configured to prevent the valve from permitting the fluid from the collapsible bag from flowing through the valve.

20. The fitment of claim 13, further comprising a probe configured to be inserted into the spout and configured to receive the fluid therethrough.

* * * * *